US005794963A

United States Patent [19]

Girard

[11] Patent Number: 5,794,963

[45] Date of Patent: Aug. 18, 1998

[54] BINDING DEVICE AND A BINDING DEVICE/ BOOT ASSEMBLY

[75] Inventor: Francois Girard, Veyrier Du Lac, France

[73] Assignee: Salomon S.A., Metz-Tessy, France

[21] Appl. No.: 707,474

[22] Filed: Sep. 5, 1996

[30] Foreign Application Priority Data

Sep. 6, 1995 [FR] France ..... 95 10587

[51] Int. Cl.[6] ..... A63C 9/08

[52] U.S. Cl. ..... 240/615; 280/634

[58] Field of Search ..... 280/611, 614, 280/615, 617, 618, 607, 634

[56] References Cited

U.S. PATENT DOCUMENTS

| | | | |
|---|---|---|---|
| 5,087,065 | 2/1992 | Provence et al. | 280/615 |
| 5,108,125 | 4/1992 | Callegari | 280/615 |

FOREIGN PATENT DOCUMENTS

| | | | |
|---|---|---|---|
| 0359964 | 3/1990 | European Pat. Off. | A63C 9/20 |
| 2632538 | 12/1989 | France | A63C 9/00 |
| 2634387 | 1/1990 | France | A63C 9/00 |
| 2645764 | 10/1990 | France | A63C 9/08 |
| 2660570 | 10/1991 | France | A63C 9/20 |
| 4428154 | 3/1995 | Germany | A63C 9/20 |

*Primary Examiner*—Richard M. Camby
*Attorney, Agent, or Firm*—Greenblum & Bernstein, P.L.C.

[57] ABSTRACT

A device for automatic binding and indexing a boot on a sporting good. The device for binding a sporting good on a corresponding boot has a transverse journal axle in a front zone of its sole and is capable of cooperating with a corresponding notch provided on a binding body affixed to the sporting good and comprises an associated latch that can be activated from a latching position to an unlatching position of the transverse journal axle of the boot and vice versa, by means of control members arranged on the binding body and acting elastically on the latch. It includes an arrangement for indexing the end of the boot on the binding body with respect to the notch in which the transverse journal axle of the boot is engaged at the time of the fitting of the sporting good, the axle being arranged at a distance from the end of the boot that is substantially equal to that separating its means for indexing the notch, so as to enable an automatic and blind fitting of the sporting device.

26 Claims, 3 Drawing Sheets

BINDING DEVICE AND A BINDING DEVICE/ BOOT ASSEMBLY

BACKGROUND OF THE INVENTION

1. Field of the Invention

The present invention relates to a device for binding a corresponding boot on a sporting item or good, and especially for a cross-country ski and an assembly of the binding device and the boot.

In this case, the binding device whose closure is effected on a transverse journal axis, or any other associated axial immobilization means provided on the boot, and providing the latter, after latching, with a certain degree of freedom, the closure of the binding device being done either manually, or automatically by the mere positioning of the boot.

2. Background and Material Information

In a known manner, the axial immobilization means or transverse axis is arranged in the front zone of the sole of the boot, and it is capable of cooperating with a complementary immobilization means such as a notch or corresponding housing provided on a binding body affixed to the ski and comprising an associated latch, that can be activated from a latching position to an unlatching position of the transverse journal axis of the boot and vice versa, by means of control members arranged on the binding body.

The aforementioned transverse journal axis is, in the case of the cross-country ski, generally arranged at the end tip of the sole of the boot, but in order to improve the control of the stability of the ski, and for the application to other sports such as biking, roller skating, telemark skiing, etc., the tendency is to position the axis behind the tip of the boot, more precisely in the articulation zone of the metatarsal bones of a skier's foot.

In this case, however, and regardless of the type of automatic or manual binding device that is used, it is easily understood that the positioning of the journal axis, located in this case beneath the sole, with respect to the notch of the binding body of the sporting good, then occurs necessarily in a blind manner.

Of course, this renders the fitting of the ski or any other sporting good difficult, especially as the athlete is then in a more or less uncomfortable position, and even more in the case of an automatic binding device whose latching must be done by means of the boot.

SUMMARY OF THE INVENTION

An object of the present invention is precisely to remedy the aforementioned disadvantage by proposing an improved binding device enabling a precise positioning of the boot during the fitting of the binding device, regardless of the position of the journal axis or any other axial immobilization means of the boot.

To this end, the binding device according to the invention which is of the type comprising a housing associated with the latching member of the boot and a latch associated with the housing and which can be activated from a latching position to an unlatching position of the latching member of the boot and vice versa, by means of control members arranged on the binding body, wherein it comprises device for indexing the end of the boot on the binding body with respect to the housing in which the latching member of the boot is engaged at the time of the fitting of the binding.

Advantageously, the latching member is arranged at the level of the articulation of the metatarsal bones of the skier's foot, at a distance from the end of the boot that is substantially equal to that separating its means for indexing the notch, so as to enable an automatic and blind fitting of the binding device.

BRIEF DESCRIPTION OF DRAWINGS

The present invention is also related to the characteristics which will become apparent along the description that follows, and which will have to be considered separately or according to all of their possible technical combinations.

This description, provided by way of non-limiting example, will help to better understand how the invention can be embodied, with reference to the annexed drawings, in which.

DETAILED DESCRIPTION OF THE PREFERRED EMBODIMENTS

Figure 1:
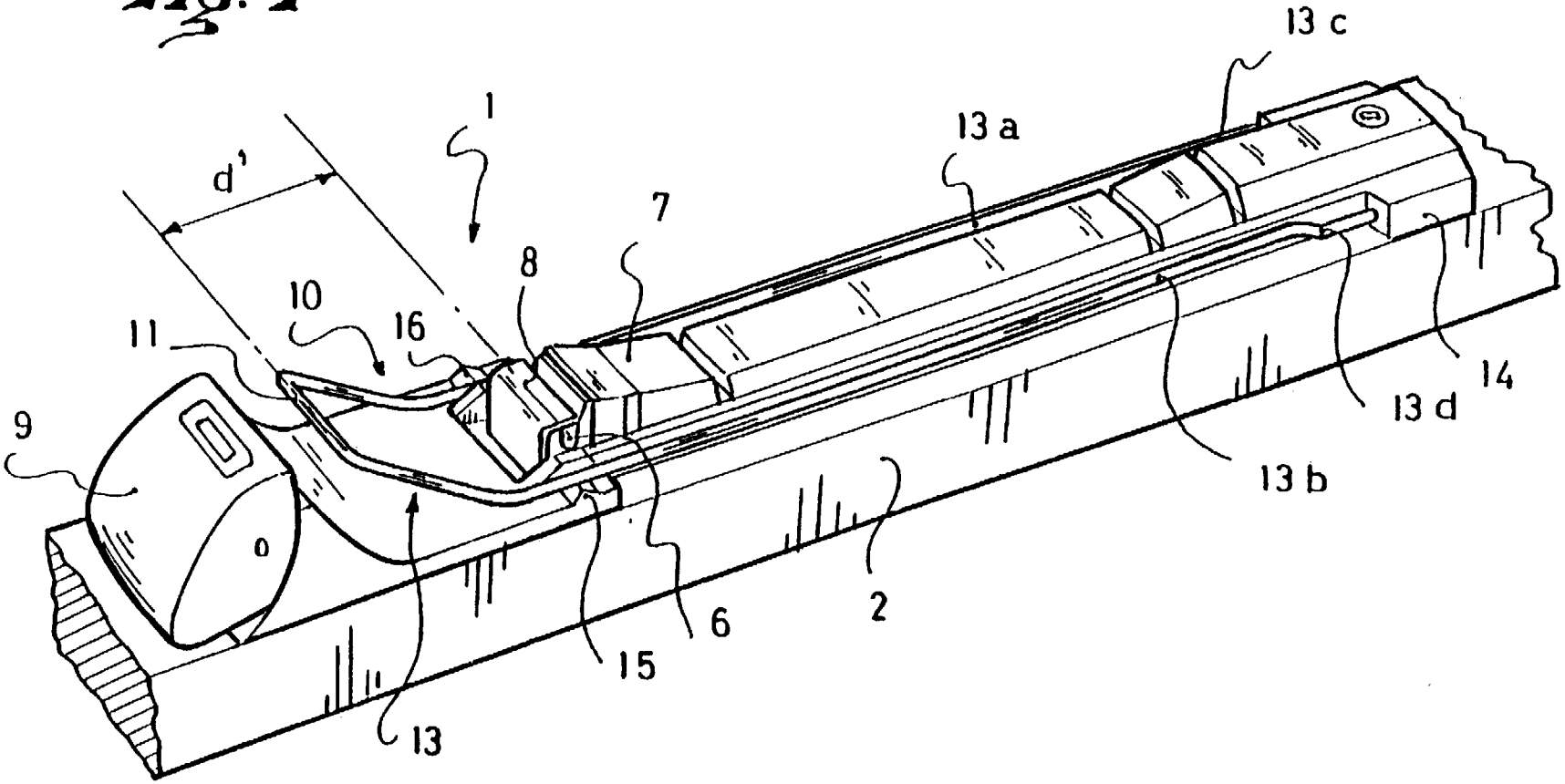
FIG. 1 shows a perspective view of a device for binding a boot on a ski, according to the invention, the device being shown alone.

The device 1 generally designated in FIG. 1 is, according to the present selected example of application, intended for the automatic binding of a corresponding boot 3 on a cross-country ski 2. Of course, such a device could also be applied to the binding of a boot to any other sports item.

The binding of the boot to the ski is accomplished by means of a transverse journal axis or axle 4 of the boot 3, arranged in a front zone of its sole 5.

The axle 4 has a section such that it is rendered capable of cooperating with a housing formed by a corresponding notch 6 arranged on a binding body 7 affixed to the ski 2, and comprising an associated latch 8 that can be activated from a latching position (FIG. 3) to an unlatching position (FIG. 2) of the transverse axle 4, or vice versa. In this case, this journal axle has a circular section to enable the pivoting of the boot. It could also be a latching member with a square section or the like, the clearance of the boot with respect to the sporting good then being provided by the flexibility of the boot.

Figure 2:
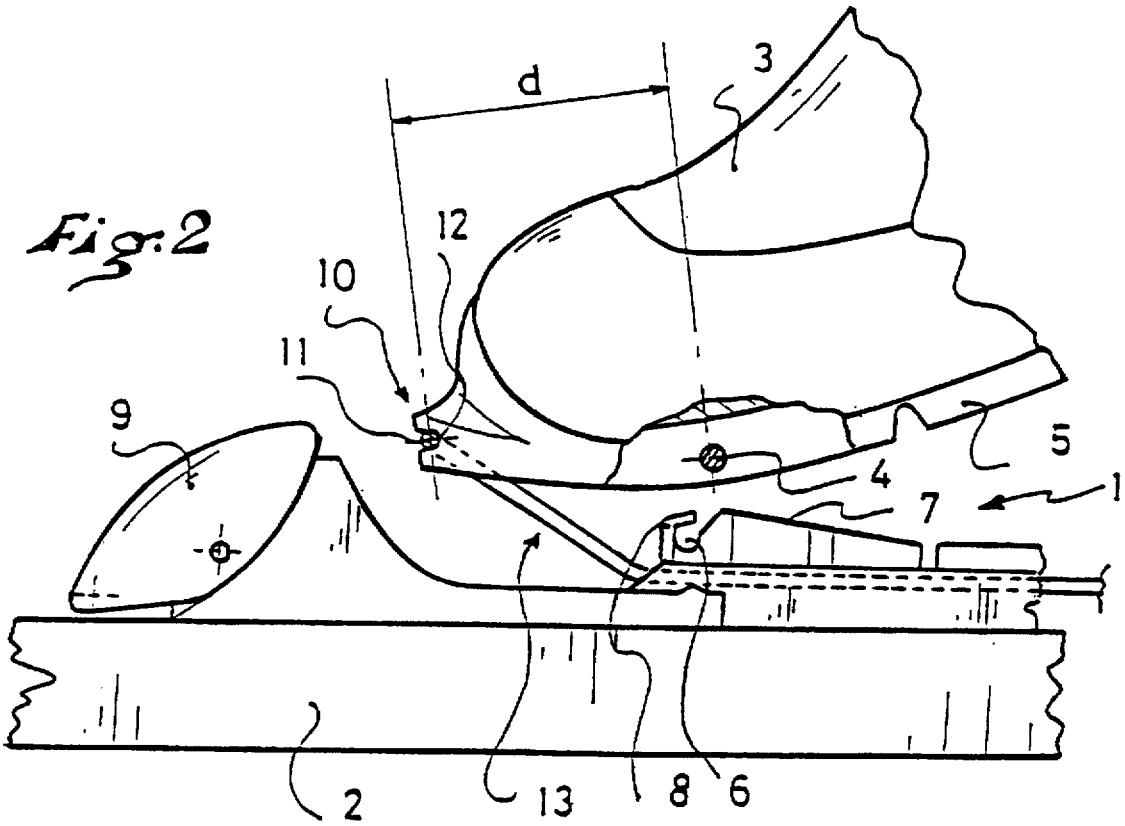
FIGS. 2 and 3 schematically show lateral views of the binding device according to FIG. 1, respectively during latching and after latching of a cross-country ski boot on a ski.

It must be noted that if FIG. 2 shows an unlatching position, it also shows a positioning of the boot on the binding body 7 during the latching thereof.

These changes of position occur by means of generally designated control members 9, acting elastically on the latch 8, these control members will not be further described, because they are known, per se, and are not the object of the present invention. This can relates especially to the control members described in the French Patent No. 2 645 764, commonly owned herewith.

According to an important characteristic of the invention, the aforementioned binding device 1 includes a structure 10 for indexing the end of the boot 3 on the binding body 7 with respect to the notch 6 in which is engaged the transverse journal axle 4 of the boot 3 which is engaged at the time of the fitting of the ski 2, the axle 4 being arranged at a distance d from the end of the boot 3 that is substantially equal to the distance d' separating the device 10 for indexing the notch 6, so as to enable an automatic and blind fitting of the ski 2. In the example of embodiment shown, the journal axle or latching member 4 of the boot is arranged substantially in the metatarsophalangeal binding zone, but such a construction of the indexing means device 10 is, of course, compatible with any other position of this latching element means 4 towards the front or the rear of the boot.

This indexing device 10 is constituted by an axial abutment 11 affixed to the binding body 7 and arranged transversely to the ski 2 at the front of the notch 6, on the one hand, and by a corresponding portion 12 located in a front end zone of the boot 3 and capable of cooperating with the abutment 11, on the other hand.

As explained above, the indexing device serves as a means for precisely locating the latching member 4 of the boot at the position of the housing 6. That is, by simply positioning the end of the boot at the abutment 11, the skier is able to precisely locate the latching member 4, at the sole of the boot, so that it will be received in the housing as the boot is continued to be lowered and latched into the binding.

Figure 3:
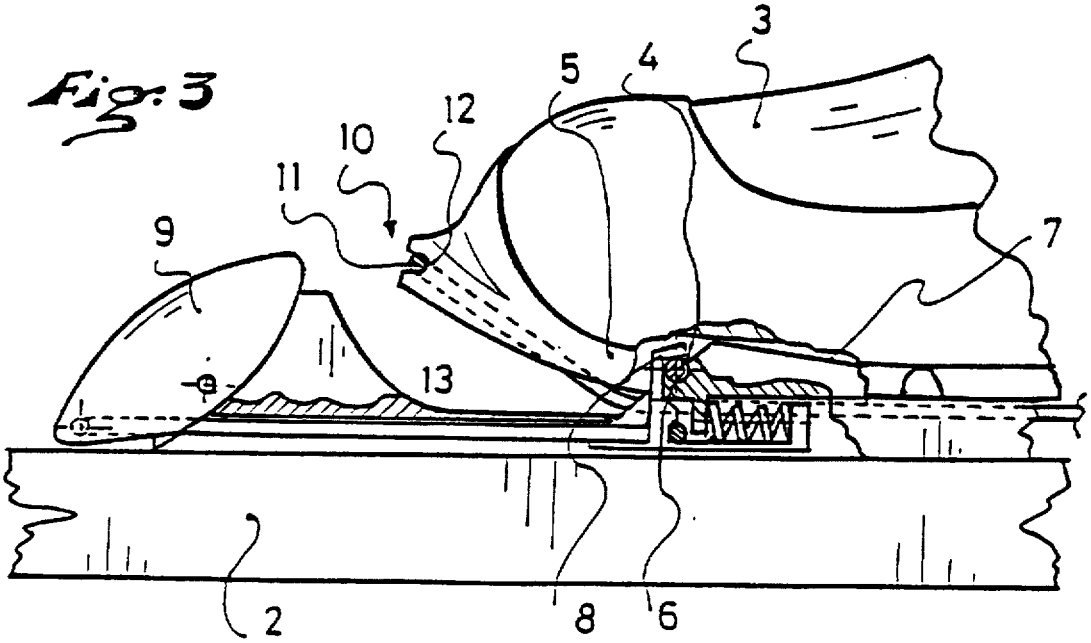

According to the particular example of embodiment shown in FIGS. 1, 2, and 3, the axial abutment 11 for indexing the boot 3 with respect to the notch 6 is formed by the transverse and arm of a length of an elongated profile member or a pin 13, generally U-shaped, whose lateral arms 13*a*, 13*b* are affixed to a fixed portion 14 of the ski 2 or to the binding device.

In fact, it is the ends 13*c*, 13*d* of arms 13*a*, 13*b* of the pin 13, opposite the transverse arm 11 that are engaged in the corresponding openings of the fixed portion 14.

According to another characteristic of the invention, the pin 13 is formed by a wire or rod whose lateral arms 13*a*, 13*b* are elastically deformable, and whose end formed by the transverse arm 11 overhangs to two lateral support points 15 and 16 of the binding or of the ski, such that the transverse arm 11 also provides an energy for returning the boot towards the ski 2, and a sensation of contact with the ground by the skier over the entire length of the boot 3. It must be noted that such a return energy is particularly appreciated for a binding device of the aforementioned type, i.e., in which the boot is attached in a single area such as the front or at the level of the metatarsophalangeal articulation zone, because it makes it possible to elastically limit the clearance of the boot with respect to the sporting good, and therefore to have a better contact sensation, and a better retention with respect to this sporting good, while maintaining the possibility of clearance of the boot with respect to the sporting good, such clearance being particularly interesting for sports such as cross-country skiing, to allow for the practice of the sport, but also for other sports, to provide a safety element, by offering a degree of freedom of the boot with respect to the sporting good to which it is connected.

Although not shown, the support points 15, 16 of the lateral arms 13*a*, 13*b* of the pin 13 can also have longitudinal adjusting means, so as to adapt its return energy, as a function of the contact sensibility desired by the athlete.

According to another characteristic, the front end portion of the boot 3 adapted to cooperate with the transverse arm 11 of the pin 13 forming the indexing axial abutment is formed by a frontwardly open groove 12 arranged at the tip of the boot 3, and having a section corresponding to that of the wire forming the pin 13.

In the case of the cross-country ski, the device 10 make it possible, in addition to the already mentioned advantages, to increase the pressure of the ski on the snow and, consequently, the edge setting, and also to have a better control and sensation of the ski.

Figure 4:
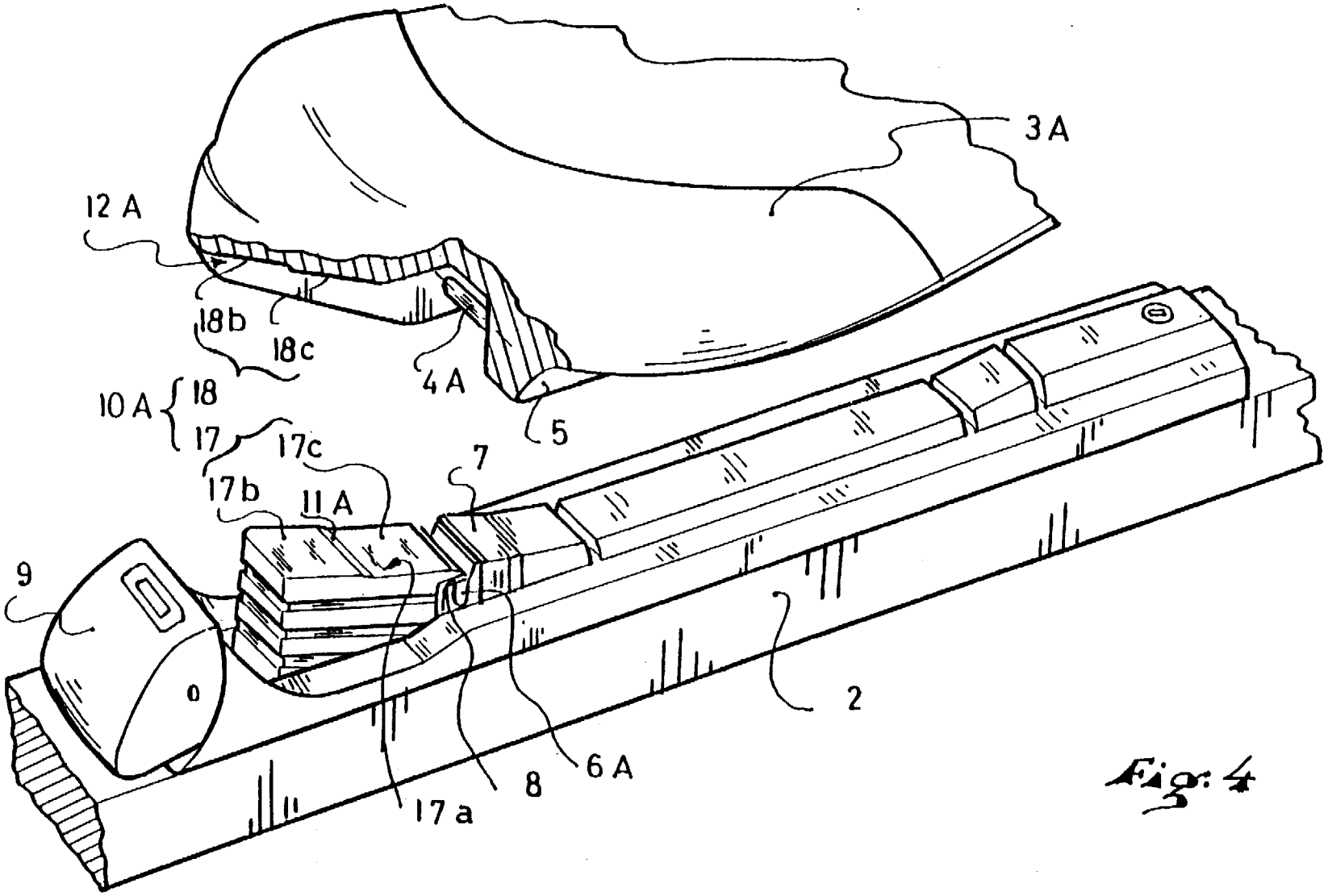
FIG. 4 is a perspective view of a binding device according to an alternative embodiment of the invention.

The embodiment shown in FIG. 4 differs essentially from the previous one in that the axial abutment for indexing the boot 3A with respect to the notch 6*a* is constituted by a transverse shoulder 11*a*, provided on an upper surface 17*a* of a support element 17 for a front end zone of the sole 5 of the boot 3*a*, affixed to a fixed portion of the ski 2.

This support element 17 is constituted by an elastically deformable elastomeric block arranged in a zone corresponding to the toes of the skier, such that the block also provides an energy for returning the boot towards the ski 2 and a sensation of contact with the ground by the skier over the entire length of the boot 3A.

According to the example shown, the transverse shoulder 11A of the support element 17 forming the axial abutment, is obtained in an intermediate zone of the upper surface 17*a* of the support element 17 to define and connect to one another two offset parallel planes 17*b*, 17*c* adapted to cooperate with portions 18*b*, 18*c* of a profile section shaped like a groove 12*a* corresponding to the front end zone of the sole 5 of the boot 3*a*, these parallel planes 17*b*, 17*c* being offset in order to better conform to the contour of the front end of the sole of the boot.

Thus, the transverse shoulder 11*a* of the support element 17 comes to nest in abutment at the time of the fitting with the corresponding portion 12*a* of the sole 5, connecting the portions 18*b* and 18*c* of the profile section 18 forming the front of the sole 5 and obtaining simultaneously the indexing axial abutment and the energy for returning the boot towards the ski.

Preferably, the transverse shoulder 11*a* forms an angle greater than 90° with respect to the offset parallel planes 17*b*, 17*c* of the support element 17 which it connects to one another.

According to a preferred embodiment, the groove 12A has a single profile section 18*c* whose slop corresponds to that of the plane 17*c* of the support element 17, such that the portion 17*b*, by coming to be pressed against the profile section 18*c* of the boot, creates a slight prestress of the latter. Such an embodiment is preferred to avoid the formation of backlashes between the boot and the binding.

The upper surface 17*a* of the support element 17 could also be planar.

The instant application is based upon French Patent Application No. 95.10587, filed on Sep. 6, 1995, the disclosure of which is hereby expressly incorporated by reference thereto in its entirety and the priority of which is claimed under 35 USC 119.

Although the invention has been described with reference to particular means, materials, and embodiments, it is to be understood that the invention is not limited to the particulars expressly disclosed, but the invention extends to all equivalents within the scope of the claims that follow.

What is claimed is:

1. A binding device for binding a boot to a sporting item, the boot having a latching member at a front end of the boot, said device comprising:

a binding body adapted to be secured to the sporting item, said binding body including a housing adapted to receive the latching member of the boot;

a latch to latch the latching member of the boot in said housing;

a control member connected to said latch for moving said latch from a latching position, for latching the latching member of the boot in said housing, to an unlatching position, for allowing unlatching of the latching member of the boot from said housing, and for moving said latch from the unlatching position to the latching position;

an indexing device to index the front end of the boot on said binding body by positioning the latching member of the boot with respect to said housing of said binding body, said indexing device comprising an element spaced from said housing a distance substantially equal to a distance between the front end of the boot and the latching member of the boot.

2. A binding device according to claim 1, wherein:

said indexing device further comprises means for applying an elastic force to the boot in a direction toward the sporting item.

3. A binding device according to claim 1, wherein:

said element of said indexing device comprises an axial abutment affixed to said binding body and adapted to extend transversely of the sporting item, a portion of the front end of the boot being adapted to abut said axial abutment as the boot is latched to the binding device.

4. A binding device according to claim 2, wherein:

said element of said indexing device comprises an axial abutment affixed to said binding body and adapted to extend transversely of the sporting item, a portion of the front end of the boot being adapted to abut said axial abutment as the boot is latched to the binding device.

5. A binding device according to claim 3, wherein:

said axial abutment comprises a transverse portion of a generally U-shaped member, said U-shaped member having a pair of laterally opposed arms being fixed with respect to the sporting item.

6. A binding device according to claim 5, wherein:

said U-shaped member comprises a wire, said arms of said wire being made of an elastically deformable material; and said binding device further comprising a pair of laterally opposed support points on which said arms are supported to provide for said transverse portion of said wire overhangs said support points.

7. A binding device according to claim 6, wherein:

said pair of support points include longitudinal adjusting means for providing for and adjustment of an elastic return force provided by said arms.

8. A binding device according to claim 1, wherein:

said element of said indexing device has a cross-sectional shape adapted to be complementary to a cross-sectional shape of a transverse groove in the front end of the boot for being received within the transverse groove.

9. A binding device according to claim 1, further comprising:

a support element for supporting a front end portion of a sole of the boot, said support element having an upper surface;

said element of said indexing device comprises a transverse shoulder provided on said upper surface of said support element.

10. A binding device according to claim 9, wherein:

said support element comprises an elastically deformable material, said elastically deformable material comprises means for applying an elastic force to the boot in a direction toward the sporting item.

11. A binding device according to claim 9, wherein:

said transverse shoulder is provided on an intermediate portion of said upper surface of said support element to define and connect to one another two offset substantially parallel planes adapted to engage respective portions of the front end portion of the sole of the boot.

12. A binding device according to claim 11, wherein:

said transverse shoulder forms an angle greater than 90° with respect to said offset substantially parallel planes.

13. An assembly of a boot and a binding device for binding the boot to a sporting item, said assembly comprising:

a boot having a latching member at a front end of said boot;

a binding device, said binding device comprising:

a binding body adapted to be secured to the sporting item, said binding body including a housing, said latching member of the boot being received within said housing;

a latch to latch said latching member of said boot in said housing;

a control member connected to said latch for moving said latch from a latching position, for latching the latching member of said boot in said housing, to an unlatching position, for allowing unlatching of said latching member of said boot from said housing, and for moving said latch from said unlatching position to said latching position;

an indexing device to index said front end of said boot on said binding body by positioning said latching member of said boot with respect to said housing of said binding body, said indexing device comprising an element spaced from said housing a distance substantially equal to a distance between said front end of said boot and said latching member of said boot.

14. An assembly according to claim 13, wherein:

said indexing device further comprises means for applying an elastic force to said boot in a direction toward the sporting item.

15. An assembly according to claim 13, wherein:

said element of said indexing device comprises an axial abutment affixed to said binding body and adapted to extend transversely of the sporting item, a portion of said front end of said boot being adapted to abut said axial abutment as said boot is latched to said binding device.

16. An assembly according to claim 14, wherein:

said element of said indexing device comprises an axial abutment affixed to said binding body and adapted to extend transversely of the sporting item, a portion of said front end of said boot being adapted to abut said axial abutment as said boot is latched to said binding device.

17. An assembly according to claim 15, wherein:

said axial abutment comprises a transverse portion of a generally U-shaped member, said U-shaped member having a pair of laterally opposed arms being fixed with respect to the sporting item.

18. An assembly according to claim 17, wherein:

said U-shaped member comprises a wire, said arms of said wire being made of an elastically deformable material; and said binding device further comprising a pair of laterally opposed support points on which said arms are supported to provide for said transverse portion of said wire overhangs said support points.

19. An assembly according to claim 18, wherein:

said pair of support points include longitudinal adjusting means for providing for an adjustment of an elastic return force provided by said arms.

20. An assembly according to claim 13, wherein:

said element of said indexing device has a cross-sectional shape complementary to a cross-sectional shape of a transverse groove provided in said front end of said boot for being received within said transverse groove.

21. An assembly according to claim 13, further comprising:

a support element for supporting a front end portion of a sole of said boot, said support element having an upper surface;

said element of said indexing device comprises a transverse shoulder provided on said upper surface of said support element.

22. An assembly according to claim 21, wherein:

said support element comprises an elastically deformable material, said elastically deformable material comprises means for applying an elastic force to said boot in a direction toward the sporting item.

23. An assembly according to claim 21, wherein:

said transverse shoulder is provided on an intermediate portion of said upper surface of said support element to define and connect to one another two offset substantially parallel planes adapted to engage respective portions of said front end portion of said sole of said boot.

24. An assembly according to claim 23, wherein:

said transverse shoulder forms an angle greater than 90° with respect to said offset substantially parallel planes.

25. An assembly according to claim 13, wherein:

said latching member of said boot comprises a transversely extending journal axle.

26. An assembly according to claim 13, wherein:

said latching member of said boot is positional substantially in a metatarsophalangeal articulation zone of said boot.

* * * * *